US006001029A

United States Patent [19]

Kobayashi

[11] Patent Number: 6,001,029

[45] Date of Patent: Dec. 14, 1999

[54] GOLF CLUB

[75] Inventor: Kenji Kobayashi, Tsubame, Japan

[73] Assignee: K.K. Endo Seisakusho, Niigata-ken, Japan

[21] Appl. No.: 09/144,740

[22] Filed: Sep. 1, 1998

[30] Foreign Application Priority Data

Dec. 4, 1997 [JP] Japan ..... 9-334132

[51] Int. Cl.[6] ..... A63B 53/04

[52] U.S. Cl. ..... 473/327; 473/345; 473/328; 473/331

[58] Field of Search ..... 473/228, 328, 473/383, 384, 345, 346, 327, 330, 331, 231, 242; D21/733, 734

[56] References Cited

U.S. PATENT DOCUMENTS

| | | |
|---|---|---|
| 1,505,296 | 8/1924 | Smith . |
| 3,997,170 | 12/1976 | Goldberg . |
| 4,065,133 | 12/1977 | Gordos . |
| 4,141,559 | 2/1979 | Melvin . |
| 4,681,323 | 7/1987 | Alaki . |
| 5,090,702 | 2/1992 | Viste . |
| 5,092,599 | 3/1992 | Okumoto . |
| 5,158,300 | 10/1992 | Aoyama . |
| 5,221,086 | 6/1993 | Antonious . |
| 5,419,556 | 5/1995 | Take . |
| 5,467,989 | 11/1995 | Good . |
| 5,700,208 | 12/1997 | Nelms . |

FOREIGN PATENT DOCUMENTS

| | | | |
|---|---|---|---|
| 0000538 | 1/1977 | Japan | 273/167 E |
| 406007484 | 1/1994 | Japan | 273/167 E |
| 9-38248 | 2/1997 | Japan . | |
| 2 012 597 | 8/1979 | United Kingdom | 273/167 E |

OTHER PUBLICATIONS

"Golf Digest", magazine, Sep. 1982 issue. See the article titled, The distance Clubs of the future . . . Available Today.

*Primary Examiner*—Sebastiano Passaniti
*Attorney, Agent, or Firm*—Quarles & Brady LLP

[57] ABSTRACT

A golf club with decreased air resistance in swinging to improve a head speed. A number of depressions 26 are formed on a back 4, a crown 6 and the side surfaces of a heel 7 and toe 8 of a head 1 of a wood club for example. Each depression 26 has a first side narrower than a second side thereof so that it is egg-shaped. The section of each depression 26 is formed smooth such that a slope at the first side is more gentle than that at the second side. Each depression 26 is desirably so oriented that its comparatively gentle slope is positioned at the face 3 side. Owing to these gentle slopes, the generation of a dead air region is suppressed at the inflow side of each depression 26, thus further decreasing an air resistance in swinging.

10 Claims, 7 Drawing Sheets

GOLF CLUB

BACKGROUND OF INVENTION

1. Field of Invention

The present invention relates to a golf club, particularly to the structure of its head.

2. Prior Art

Conventionally, whilst the outside surface of a golf club such as a wood or an iron club was formed with a plurality of concave grooves called score lines on a ball-striking face, or with a cavity on a back side for an iron head, such conventional golf club had its outside surface formed comparatively smooth, without providing noticeable irregularities thereon. With such smooth outside surface, however, a greater air resistance is resulted, preventing the improvement of so-called a head speed.

Whereas, as described in Japanese Patent Un-Examined Publication No.9-38248, it is a known art to form a hollow metallic golf club head. The head, for example, is constructed by joining a plurality of forged metallic shells together. However, with the head whose outside and inside surfaces are formed smooth as described above, the strength of its outer shell is relatively made weak. Therefore, according to the conventional head, the thickness of the outer shell was formed thick to a certain extent, which in turn made it difficult to enlarge the head without increasing the weight of the head. With a large-sized head, even a beginner player can strike balls without failures, which advantage comes to nothing if the weight of the head is increased.

SUMMARY OF THE INVENTION

To eliminate the above problems, it is, therefore, a primary object of the invention to provide a golf club which realizes less air resistance in swinging so that a head speed can be improved.

It is a secondary object of the invention to provide a golf club whose outer shell can be made thinner without degrading the strength thereof, particularly for a hollow metallic head.

To attain the above objects, there is provided a golf club comprising: a head having a face on a front; a shaft connected to said head; and a plurality of depressions formed on an outside surface of said head, each depression having a first side and a second side opposite to the first side, wherein each depression is egg-shaped such that a width thereof at the first side is smaller than that at the second side, having a smoothly curved cross-section with a slope at said first side being more gentle than that at said second side.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 2 is an explanatory view for explaining an action of a head of a first embodiment of the invention, in which

DETAILED DESCRIPTION OF THE INVENTION

Figure 1:
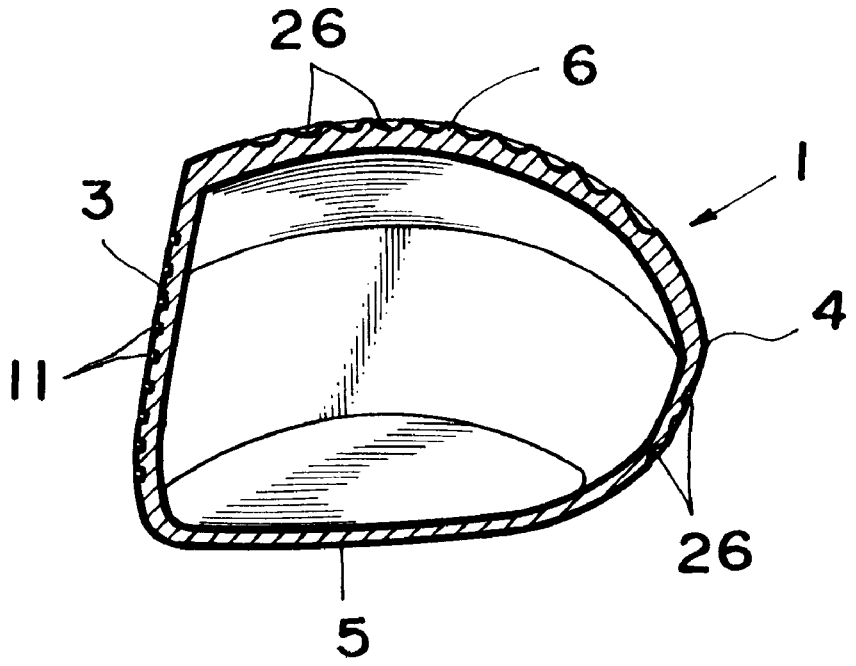
FIG. 1 is a section showing a head of a first embodiment of a golf club of the invention.

Hereinafter is explained a first embodiment of a golf club of the invention with reference to FIG. 1 through FIG. 7.

A golf club of the present embodiment is a wood club, consisting of a hollow metallic head 1 and a shaft 2 connected to the head 1. The head 1 has a face 3 at its front side, a back 4 at its back side, a sole 5 at its lower side, a crown 6 at its upper side, a heel 7 at its proximal side and a toe 8 at its distal side, respectively. The upper portion of the heel 7 is formed with a neck 9, from which extends upwardly a hosel 10. The hosel 10 serves as a shaft connecting portion for connecting a shaft 2 thereto. Incidentally, a plurality of nearly horizontal concave grooves 11, which are called score lines, are formed on said face 3.

Figure 7:
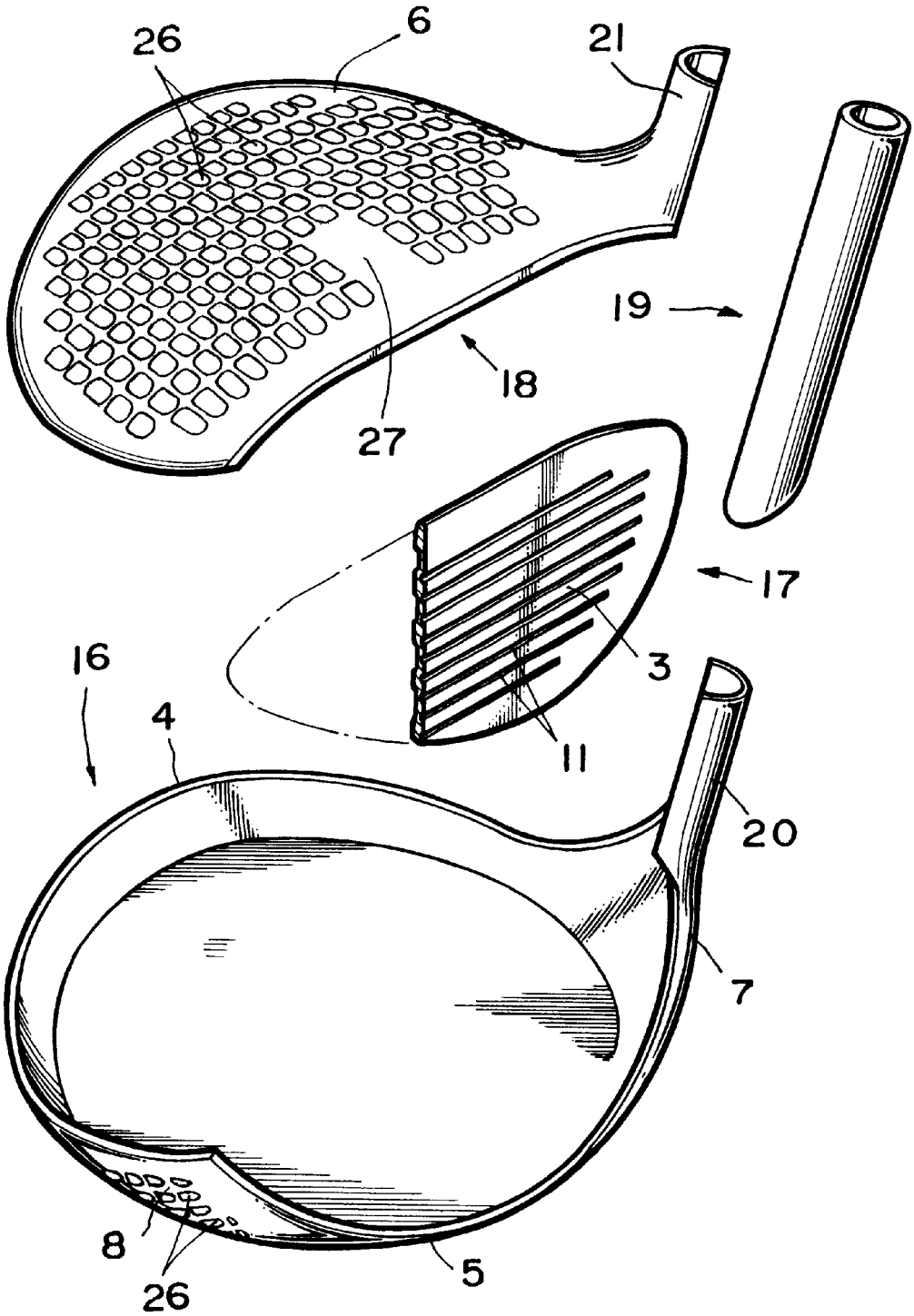
FIG. 7 is a partially cutaway exploded perspective view showing a head of the first embodiment of the invention.

The head 1 is constructed by for example joining a plurality of forged metallic shells together by welding or the like. As illustrated in FIG. 7, the head 1 in accordance with the present embodiment is constructed by metallic shells consisting of a body member 16, a face member 17, a crown member 18 and a mounting pipe 19. The body member 16 forms the back 4, sole 5, heel 7 and toe 8, while the face member 17 the face 3, the crown member 18 the crown 6, and the mounting pipe 19 the hosel 10, respectively.

The body member 16 is formed with one semi-cylindrical portion 20 which forms one side of the outer surface of the hosel 10, while the crown member 18 is formed with the other semi-cylindrical portion 21 which forms the other side of the outer surface thereof. In assembling the same, the edges of the body member 16, the face member 17 and the crown member 18 are welded to one another, while the lower end of the mounting pipe 19 is welded to the lower portion of the body member 16, and then, the respective semi-cylindrical portions 20 and 21 of the body member 16 and the crown member 18 are mounted so as to cover the upper portion of the mounting pipe 19 so that they are welded thereto. Alternatively, a hollow interior of the head 1 may be filled with urethane foamed material.

The outside surface of the head 1 is formed with a number of depressions 26, which are provided on the back 4, the crown 6, a side face at the heel 7 side and another side face at the toe 8 side. Each depression 26 is so formed that it is symmetric with respect to a single line only, each comprising a gentle slope 26*a* at one side, and a steep slope 26*b* at the other side. Further, each depression 26 is formed to the shape of an egg in a plan view orthogonal to the direction which defines the depth of the depression 26, such that a width at the gentle slope 26*a* side is smaller than that at the steep slope 26*b* side. It should be noted that a section view of each depression indicates that the slope at the gentle slope 26*a* side is more gentle than that at the steep slope 26*b* side.

For each depression 26 on the back 4, the gentle slope 26*a* is provided at the toe 8 side, while the steep slope 26*b* at the heel 7 side. For each depression 26 on the side faces at the crown 6 and the toe 8 side, the gentle slope 26*a* is provided at the face 3 side, while the steep slope 26*b* at the back 4 side. On the other hand, for each depression 26 on the side face at the heel 7 side, the gentle slope 26*a* is provided at the back 4 side, while the steep slope 26*b* at the face 3 side.

Whilst the crown 6 is formed with the depressions 26 which are arranged on an approximately entire area thereof, it should be noted that there is a region on the crown 6 without the depressions 26, located in the middle of the longitudinal length of the face 3 at the front side of the crown 6. The region serves as a center indicator 27, which enables a player to easily address a ball to a sweet spot, i.e., the center of the longitudinal length of the face 3, when he strikes a ball.

Next, the action of the above-described structure will be explained.

Figure 2A:
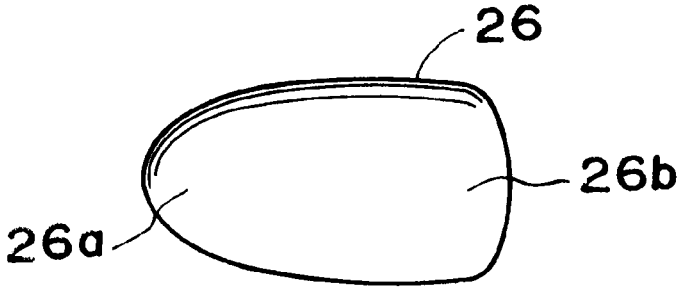
FIG. 2A is a plan view showing the vicinity of a depression of the embodiment, FIG. 2B a section thereof, FIG. 2C a plan view showing the vicinity of a depression of a comparative example, and FIG. 2D a section thereof, respectively.
Figure 2B:
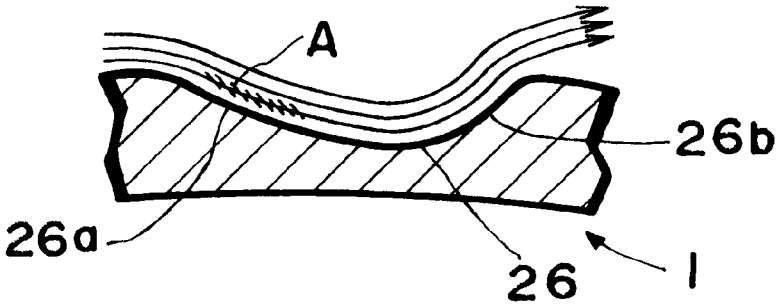
Figure 2C:
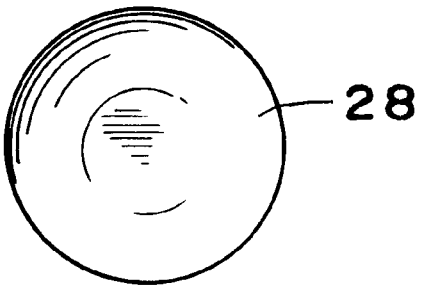
Figure 2D:
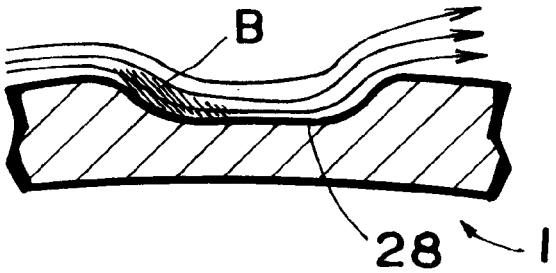
Figure 3:
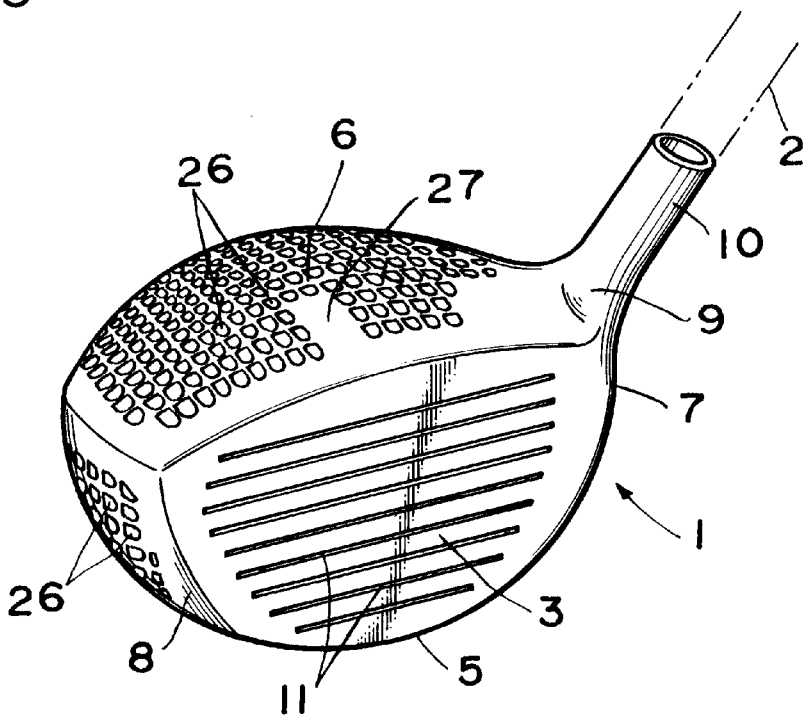
FIG. 3 is a perspective view showing a head of the first embodiment of the invention.
Figure 4:
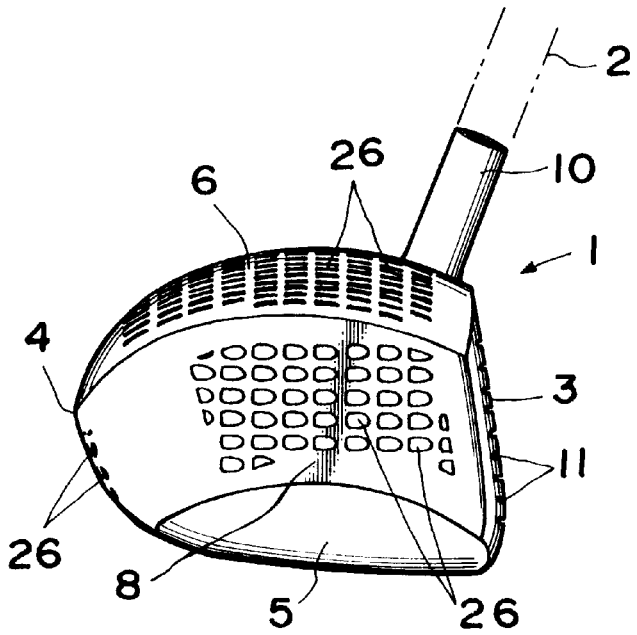
FIG. 4 is a left side view showing a head of the first embodiment of the invention.
Figure 5:
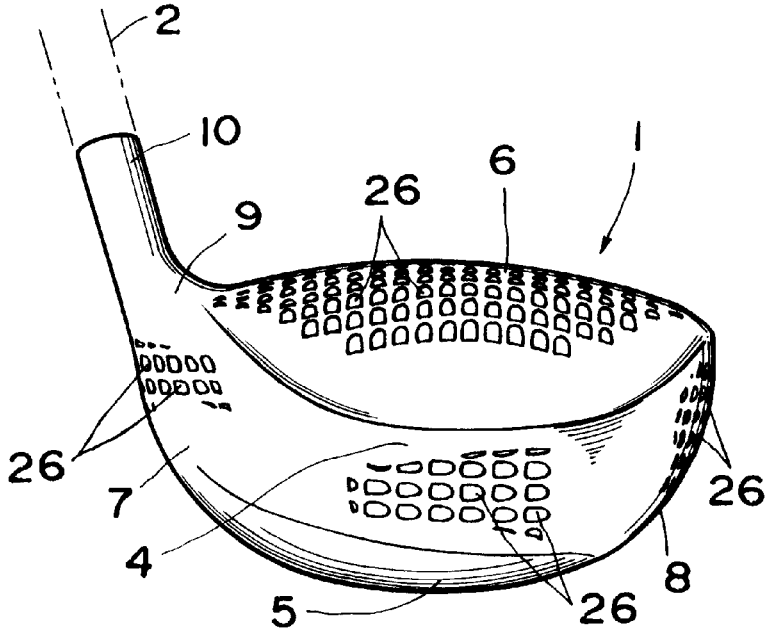
FIG. 5 is a rear view showing a head of the first embodiment of the invention.
Figure 6:
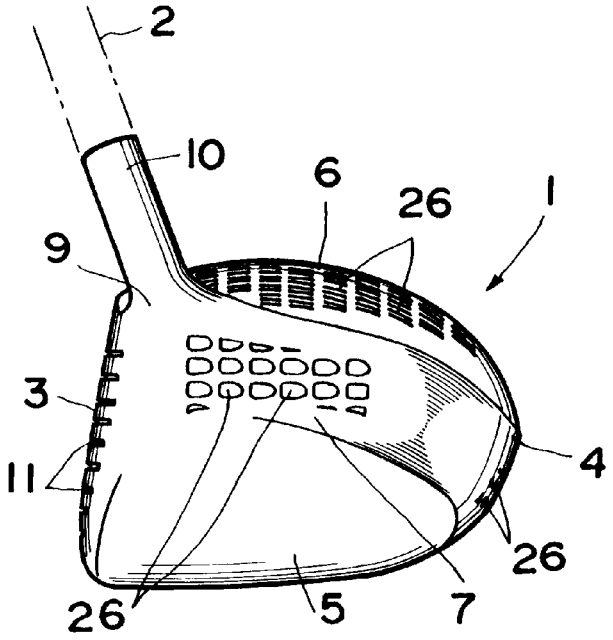
FIG. 6 is a right side view showing a head of the first embodiment of the invention.

When swinging a golf club to strike a ball, the air resistance to the head 1 is decreased due to the depressions 26 formed on the outside surface of the head 1, thereby improving a head speed. Further, each depression 26 is egg-shaped such that one side thereof being narrower than the other side thereof, said one side being defined as the gentle slope 26*a* which is more gentle than the steep slope 26*b* at the other side, whereby when the air flows in the direction from the gentle slope 26*a* side to the steep slope 26*b* side, around the head 1, the air is allowed to flow smoothly even at the inflow side of each depression 26, as illustrated with arrows in FIG. 2B. As a result, the generation of so-called a dead air region A as illustrated with downward-slanting hatching in FIG. 2B is suppressed at the inflow side thereof, at the same time the generation of an vortex or eddy flow also is suppressed. Thus, the air resistance at the time of striking balls is decreased further. In contrast, a comparative depression 28 is illustrated in FIGS. 2C and 2D, which is of a round shape and a symmetrical cross-section. In this case, a large dead air region B as illustrated with downward-slanting hatching in FIG. 2D is generated at the inflow side of the depression 28, at the same time more vortex or eddy flow also is generated, thus resulting in a larger air resistance.

According to the embodiment of the invention, as each depression 26 on the crown 6 and the toe 8 is formed with the gentle slope 26*a* at the face 3 side, while with the steep slope 26*b* at the back 4 side, the above-described action resulting from the unique shape of the depression 26 is ensured when the air generally flows from the face 3 side to the back side of the head 1 at the time of swinging the same. Furthermore, as the depressions 26 are provided on the crown and the side surfaces of the heel 7 and toe 8 of the head 1, said crown and side surfaces extending nearly along the swinging direction, these depressions 26 will work more effectively, so that the air resistance in swinging is further decreased, thereby improving a head speed.

The foregoing embodiment is further advantageous in that as a number of depressions 26 are formed on the outer shell of the hollow metallic head 1, the strength of the head 1 is improved, so that the thickness of the outer shell can be made small without degrading the strength of the head 1.

In this case, the reason why the strength is improved by the formation of the depressions 26 is that even and fine tissues are resulted from the forging of the depressions 26, while producing so-called grain flows, which leads to the improved stiffness and durability of the material. Further, as each depression is formed smooth, the grain flows are made unlikely to be disconnected, thus further improving the strength. In addition, even the dispersion of impacts can be expected as an effect of the irregular shape of the outer shell of the head 1.

In any case, since the outer shell of the head 1 can be made thinner, the head 1 can be enlarged without increasing the weight of the head 1. With such enlarged head 1, so-called sweet area, i.e., an area on the face 3 where balls can travel comparatively straight and well when struck thereon, is enlarged, whereby there can be provided a golf club with which even a beginner player can strike balls without failures. At the same time, a degree of freedom in weight distribution of the whole head 1 is improved. In addition, an original and distinguished design can be imparted to the appearance of the head 1 owing to the depressions 26.

Figure 8:
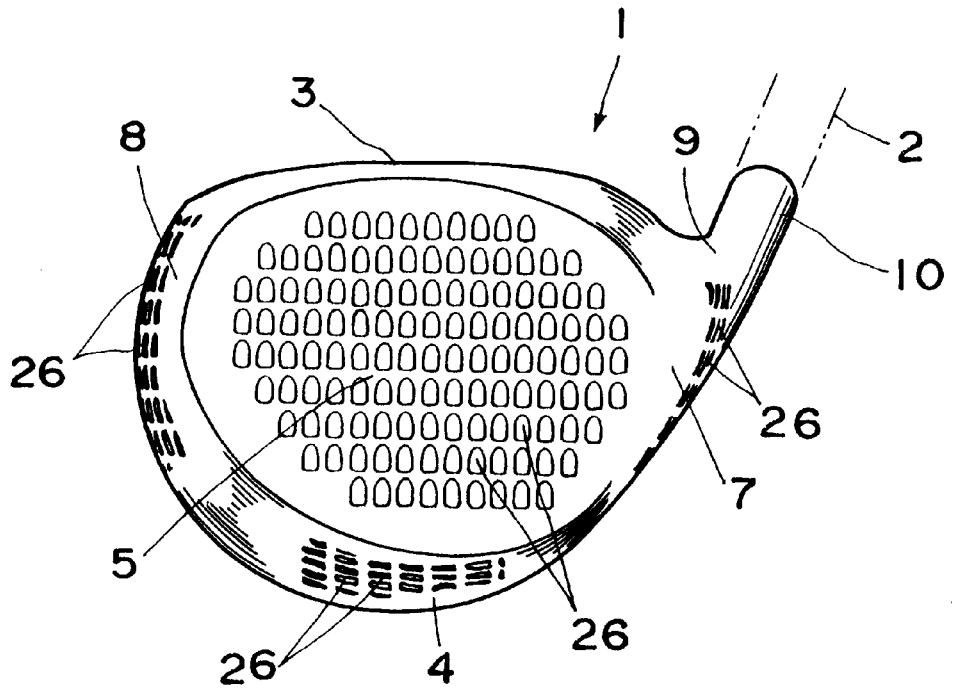
FIG. 8 is a bottom plan view showing a head of a second embodiment of the invention.

In FIG. 8 showing a second embodiment of a gold club of the invention, the same portions as those described in the first embodiment will be designated by common reference numerals, and their repeated detailed descriptions will be omitted. The same applies to a hereinafter-described third embodiment of the invention.

In a second embodiment, the golf club in accordance with the first embodiment further comprises a number of the depressions 26 formed on an outside surface of the sole 5 of the head 1. Whilst each of these depressions 26 is of the same shape as that of the other depressions 26 provided on the other positions, it is formed with the gentle slope 26*a* at the face 3 side, while with the steep slope 26*b* at the back 4 side. Since the sole 5 also is formed with the depressions 26 this way, the effect of decreasing the air resistance in swinging so as to improve a head speed, is further enhanced.

Figure 9:
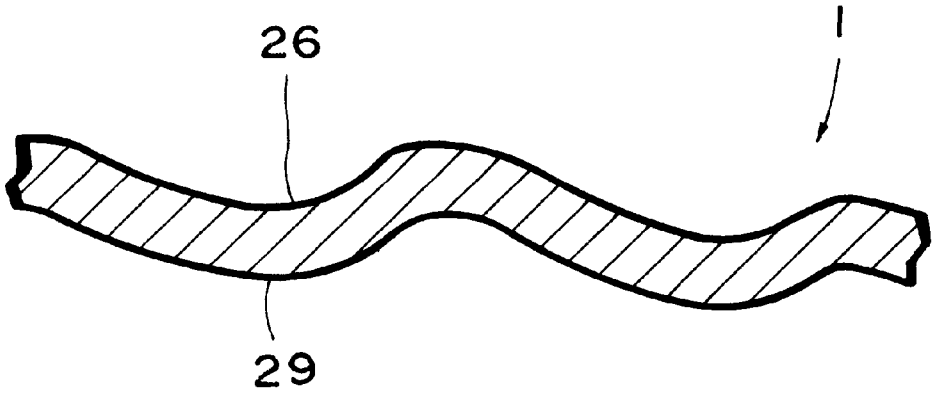
FIG. 9 is a section showing the vicinity of depressions of a head of a third embodiment of the invention.

FIG. 9 shows a third embodiment of the invention. Unlike the first embodiment where the depressions 26 are formed on only the outside surface of the hollow head 1 and the inside surface of the outer shell thereof is formed smooth, the third embodiment proposes that the outside surface of the outer shell of the head 1 may be formed approximately similar to the inside surface thereof, with expansions 29 being provided on the inside surface thereof, corresponding to each depression 26 on the outside surface thereof.

Incidentally, the present invention should not be limited to the foregoing embodiments, but may be modified within a scope of the invention. For example, in the foregoing embodiments, each depression 26 on the side surface of the heel 7 is formed at the back side with the gentle slope 26*a*, while at the front side with the steep slope 26*b*, which may be provided vice versa. The positions where the depressions 26 are to be provided should not be limited to the back 4, the crown 6, the side surfaces of the heel 7 and the toe 8, or including the sole 5 also, they may be formed on suitable positions on the outside surface of the head 1, such as only on the sole 5 or only the crown 6, etc. Further, although the foregoing embodiments are described, taking an example of a wood golf club, the present invention is applicable to any other types such as iron golf club. Specifically, for an iron club, it would be effective to form the depressions on the sole thereof, from the dimensional relationship among each surface thereof. Alternatively, the head of the invention should not be limited to a hollow metallic head, but may be a solid or a wooden head.

What is claimed:

1. A golf club comprising: a head having a face on a front; a shaft connected to said head; and a plurality of depressions formed on an outside surface of said head, each depression having a first side and a second side opposite to the first side, wherein each depression in plan view has a width thereof at the first side being smaller than the width at the second side, each depression having a smoothly curved cross-section with a slope at said first side being more gentle than the slope at the second side, whereby when air flows in a direction from the first side to the second side, the generation of a dead-air region is substantially suppressed at the time of striking a golf ball.

2. A golf club according to claim 1, wherein said first side of each depression is a face side, while said second side is a back side.

3. A golf dub according to claim 1, wherein said depressions are formed on an upper surface of said head.

4. A golf dub according to claim 3, wherein said depressions are further formed on one or more side surfaces of said head.

5. A golf dub according to claim 3, wherein said depressions are further formed on a lower surface of said head.

6. A golf club according to claim 3, further comprising a depression-free area provided in the middle of the longitudinal length of the face of said head in order for said depression-free area to serve as a center indicator.

7. A golf dub according to claim 1, wherein said head is hollow and metallic.

8. A golf dub according to claim 7, wherein said head has an inside surface formed with expansions, corresponding to said depressions.

9. A golf dub according to claim 1, wherein said head is constructed by joining a plurality of metallic shells together.

10. A golf club according to claim 9, wherein said depressions are formed by forging at the time of forging said metallic shells.

* * * * *

UNITED STATES PATENT AND TRADEMARK OFFICE

CERTIFICATE OF CORRECTION

Patent No. : 6,001,029

Dated : Dec. 14, 1999

Inventor(s) : Kobayashi

It is certified that errors appear in the above-identified patent and that said Letters Patent is hereby corrected as shown below:

Col. 5, line 10, "dub" should be -- club -- .

Col. 5, line 12, "dub" should be -- club -- .

Col. 5, line 15, "dub" should be -- club -- .

Col. 6, line 5, "dub" should be -- club -- .

Col. 6, line 7, "dub" should be -- club -- .

Col. 6, line 10, "dub" should be -- club -- .

Signed and Sealed this

Twenty-second Day of May, 2001

*Attest:*

Nicholas P. Godici

NICHOLAS P. GODICI

*Attesting Officer*

*Acting Director of the United States Patent and Trademark Office*